US011497943B2

(12) United States Patent
Pan

(10) Patent No.: US 11,497,943 B2
(45) Date of Patent: Nov. 15, 2022

(54) SMART EMERGENCY ESCAPE BACKPACK

(71) Applicant: Tai Zhou Luxi Tools Co., Ltd., Zhejiang (CN)

(72) Inventor: Xinggang Pan, Zhejiang (CN)

(73) Assignee: Tai Zhou Luxi Tools Co., Ltd., Zhejiang (CN)

( * ) Notice: Subject to any disclaimer, the term of this patent is extended or adjusted under 35 U.S.C. 154(b) by 369 days.

(21) Appl. No.: 16/622,589

(22) PCT Filed: Oct. 23, 2017

(86) PCT No.: PCT/CN2017/107251
§ 371 (c)(1),
(2) Date: Dec. 13, 2019

(87) PCT Pub. No.: WO2018/227835
PCT Pub. Date: Dec. 20, 2018

(65) Prior Publication Data

US 2020/0330800 A1 Oct. 22, 2020

(30) Foreign Application Priority Data

Jun. 14, 2017 (CN) ..... 201710446157.0

(51) Int. Cl.
*A62B 1/10* (2006.01)
*A62B 1/16* (2006.01)
(Continued)

(52) U.S. Cl.
CPC ..... *A62B 1/16* (2013.01); *A62B 1/18* (2013.01); *A62B 35/0037* (2013.01); *A62B 1/08* (2013.01)

(58) Field of Classification Search
CPC .... A62B 1/16; A62B 1/18; A62B 1/08; A62B 1/10; A62B 35/0037; B66D 1/36;
(Continued)

(56) References Cited

U.S. PATENT DOCUMENTS 3,889,777 A * 6/1975 George ..... A62B 1/10 182/193
4,567,963 A * 2/1986 Sugimoto ..... H02K 49/046 182/236
(Continued)

FOREIGN PATENT DOCUMENTS

CN 2352204 Y 12/1999
CN 201433017 Y 3/2010
(Continued)

OTHER PUBLICATIONS

International Search Report for International Application No. PCT/CN2017/107251 dated Mar. 1, 2018.

*Primary Examiner* — Brian D Mattei
*Assistant Examiner* — Kathleen M. McFarland
(74) *Attorney, Agent, or Firm* — Young Basile Hanlon & MacFarlane, P.C.

(57) ABSTRACT

Disclosed is a smart emergency escape backpack, comprising a harness bound to a user and a controlled descent mechanism; wherein the controlled descent mechanism includes an anchor support, a hub mounted on the anchor support, and a centrifugal speed reduction damper fitted with the hub, a cable being wound around the hub; wherein a cable take-up actuating mechanism is further provided on the anchor support, and the cable take-up actuating mechanism includes an electric motor, a transmission structure connected to the electric motor, and a synchronous wheel connected to the transmission mechanism, the synchronous wheel actuating the hub to rotate reversely.

10 Claims, 7 Drawing Sheets

(51) Int. Cl.
*A62B 1/18* (2006.01)
*A62B 35/00* (2006.01)
*A62B 1/08* (2006.01)

(58) Field of Classification Search
CPC .... B66D 1/60; B66D 1/12; B66D 2700/0191; H02G 11/02; F16D 49/20; F16D 49/10; F16D 49/16; F16D 49/22; F16D 51/10; E06C 7/18
See application file for complete search history.

(56) References Cited

U.S. PATENT DOCUMENTS 4,674,599 A * 6/1987 Nelson ..... A62B 1/08 182/71
2001/0023793 A1* 9/2001 Okamura ..... A62B 1/02 182/7
2004/0055824 A1* 3/2004 Karnes ..... A62B 1/10 182/234
2004/0245048 A1* 12/2004 Ribic ..... A62B 1/06 182/233
2005/0039981 A1* 2/2005 Wooster ..... A62B 1/10 182/75
2007/0261921 A1* 11/2007 Gal ..... A62B 1/08 182/233
2010/0163343 A1* 7/2010 Stone ..... A62B 1/10 182/234
2010/0181145 A1* 7/2010 Hobson ..... A62B 1/10 475/331
2010/0308149 A1* 12/2010 Allington ..... A63B 69/0048 242/379
2014/0318896 A1* 10/2014 Larsson ..... A62B 35/0093 182/234
2015/0307197 A1* 10/2015 Sienna ..... B64D 25/08 182/232
2015/0345157 A1* 12/2015 Santos Junior ..... B66D 1/7489 182/14
2015/0352380 A1* 12/2015 Huang ..... A62B 1/10 188/65.3
2017/0007857 A1 1/2017 Meng
2017/0157432 A1* 6/2017 Lian ..... F16H 3/02

FOREIGN PATENT DOCUMENTS

CN 102502425 A 6/2012
CN 205460533 U * 8/2016
CN 205460533 U 8/2016
CN 205698933 U 11/2016
CN 106215337 A 12/2016
CN 106422093 A 2/2017
CN 107198837 A 9/2017
GB 756793 A 9/1956
JP 2000271238 A 10/2000

* cited by examiner

SMART EMERGENCY ESCAPE BACKPACK

CROSS-REFERENCE TO RELATED APPLICATION(S)

This application is a 371 application of International Application No. PCT/CN2017/107251, filed on Oct. 23, 2017, which claims priority to Chinese Patent Application No. 201710446157.0, filed on Jun. 14, 2017, the entire disclosures of both of which are hereby incorporated by reference in their entireties.

TECHNICAL FIELD

The present disclosure relates to an escape gear, and more specifically relates to a smart emergency escape backpack for a high-rise building.

BACKGROUND

Conventionally, upon a fire emergency occurring to a high-rise building, it is difficult to rescue persons in high stories. As people in higher stories can hardly be rescued by conventional fire protection equipment; they can only rely on themselves for rescue. With more and more high-rise buildings emerging, a personal self-escape gear applicable for high-rise buildings is in urgent need. For example, the invention patent application No. CN201610673055.8, published on Feb. 22, 2017, discloses a controlled descent emergency escape apparatus, comprising: a housing including a front anchor plate and a rear anchor plate which are arranged in parallel; a controlled descent wheel pivoted between the front anchor plate and the rear anchor plate; a cable wound around the outer edge of the controlled descent wheel; a cable guiding mechanism disposed above the controlled descent wheel, the cable guiding mechanism connecting the upper portions of the front and rear anchor plates, one end of the cable being fixed on the controlled descent wheel, the free end of the cable penetrating through the cable guiding mechanism; and further a junction plate securely connected with the outer side of the rear anchor plate, wherein the controlled descent emergency escape apparatus is anchored inside a customized backpack via the junction plate. The controlled descent wheel comprises a rotating body and a speed reduction mechanism provided at a side portion of the rotating body, and a controlled descent mechanism being provided inside the rotating body, the rotating body and the controlled descent mechanism being connected via the speed reduction mechanism. The controlled descent mechanism comprises a rotating shaft and a centrifugal arm, the centrifugal arm and the rotating shaft being perpendicular to each other. A centrifugal slide block is provided on the centrifugal arm. The rotating shaft is fitted to the front and rear anchor plates and the end cap of the rotating body via bearings. The speed reduction mechanism includes a center gear, a planetary gear, and an outer ring gear, wherein the center gear is disposed at the center of the planetary gear, the outer ring gear is provided at the outer edge of the planetary gear, the center gear is securely connected with the rotating shaft, the planetary gear is pivoted to the outer side of the end cap of the rotating body, and the outer ring gear is secured on the outer sidewall of the rotating body. The radian of the outer edge of the centrifugal slide block is matched with the median of the inner wall of the rotating body; a lap of guide convex ring is provided on the inner wall of the rotating body; and a recessed groove fitted to the guide convex ring is provided at the outer edge of the centrifugal slide block. However, the controlled descent emergency escape apparatus disclosed above cannot be timely taken up such that it can only be used by one person for one time. Further, it is impossible to equip such an apparatus for each person in a high-rise building. Therefore, this drawback limits promotion and application of such an emergency escape apparatus, which also increases use costs.

SUMMARY

In an effort to overcome the drawbacks in the prior art, the present disclosure provides a smart emergency escape backpack which is easy to take up, safe and reliable, and may be used repeatedly by multiple persons.

A smart emergency escape backpack according to the present disclosure comprises a harness bound to a user and a controlled descent mechanism; wherein the controlled descent mechanism includes an anchor support, a hub mounted on the anchor support, and a centrifugal speed reduction damper fitted with the hub, a cable being wound around the hub; wherein a cable take-up actuating mechanism is further provided on the anchor support, and the cable take-up actuating mechanism includes an electric motor, a transmission structure connected with the electric motor, and a synchronous wheel connected with the transmission mechanism, the synchronous wheel actuating the hub to rotate reversely.

In the smart emergency escape backpack, a cartridge battery is further provided on the anchor support, the battery being electrically connected with the electric motor, one side of the anchor support being provided with a battery plug socket, the battery being plugged in the battery plug socket.

In the smart emergency escape backpack, the transmission mechanism is a timing belt, and the synchronous wheel is a timing pulley, the electric motor being connected with the timing pulley via the timing belt.

In the smart emergency escape backpack, an accommodation cavity is formed on the anchor support, the transmission mechanism and the synchronous wheel being mounted in the accommodation cavity.

In the smart emergency escape backpack, the centrifugal speed reduction damper comprises a rotating spindle, centrifugal damping blocks symmetrically disposed, guide rods fixedly connected with the centrifugal damping blocks, and a hollow guiding conduit connected vertically and securely to the spindle, the guide rods being respectively inserted from two ends of the hollow guiding conduit, a spring being disposed between the two guide rods, the spring being disposed in the hollow guiding conduit, such that when the spindle rotates, the centrifugal damping blocks abut against the inner wall of the hub under the action of a centrifugal force.

In the smart emergency escape backpack, a damping chamfer is formed on each of the centrifugal damping blocks, a damping groove is formed on the inner wall of the hub, and the damping chamfers and the sidewall of the damping groove are in fricative contact.

In the smart emergency escape backpack, the hub actuates the spindle to rotate via a planetary gear transmission mechanism, the spindle driving the centrifugal damping blocks to rotate, the rotating direction of the centrifugal damping blocks is contrary to the rotating direction of the hub, the synchronous wheel being fixed on the spindle.

In the smart emergency escape backpack, a cable take-up and pay-off guiding mechanism, the guiding mechanism including a first guide roller set and a second guide roller set which are arranged perpendicular to each other, the first guide roller set and the second guide roller set respectively including two guide rollers, wherein the diameter of the guide roller, around which the cable is bent and wound in the first guide roller set, is greater than diameters of other guide rollers.

In the smart emergency escape backpack, a travel switch electrically connected with the cable take-up actuating mechanism is further provided on the anchor support, the free end of the cable being provided with an expanded portion, the expanded portion snap-acting on the travel switch.

In the smart emergency escape backpack, the travel switch comprises a hollow base and a pull rod inserted into the base, an electrical contact being provided on the base, the electrical contact being bulged into the hollow cavity of the base, an electrically conducting ring being provided on the portion of the pull rod which is inserted into the hollow cavity of the base, the electrically conducting ring being in contact with the electrical contact, the pull rod being provided with a through-hole, the cable passing through the through-hole, the expanded portion pushing the pull rod to reset.

In the smart emergency escape backpack, a locating mechanism is provided on the base; the locating mechanism includes a bead projecting into the hollow cavity, a spring pushing the bead, and a thread abutting against the spring; and a locating groove is provided on each of the pull rod and the electrically conducting ring, respectively, the bead being snapped into the locating grooves.

Compared with the prior art, the smart emergency escape backpack according to the present disclosure offers the following advantages: with the cable take-up actuating mechanism provided by the present disclosure, the electric motor may automatically take up the cable so as to recover the controlled descent mechanism to the initial state, thereby facilitating repeated use by multiple persons. Therefore, with a certain number of the smart emergency escape backpacks as disclosed herein to a high-rise building, it suffices for repeated emergency escape use for multiple persons. Besides, the emergency escape backpack as disclosed is easy for collective management and purchase and is easy for being stored in a specific area, thereby facilitating promotion and use.

DETAILED DESCRIPTION

Figure 1:
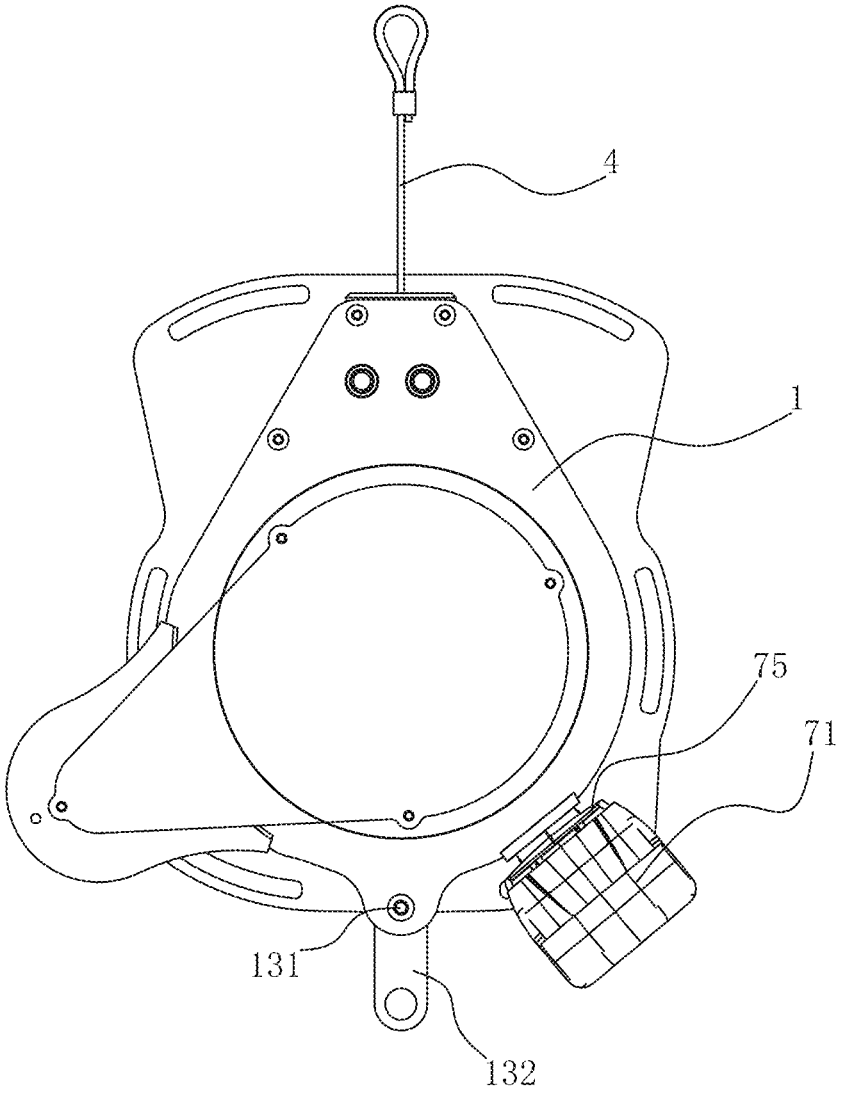
FIG. 1 is a front view of a controlled descent mechanism according to the present disclosure.
Figure 2:
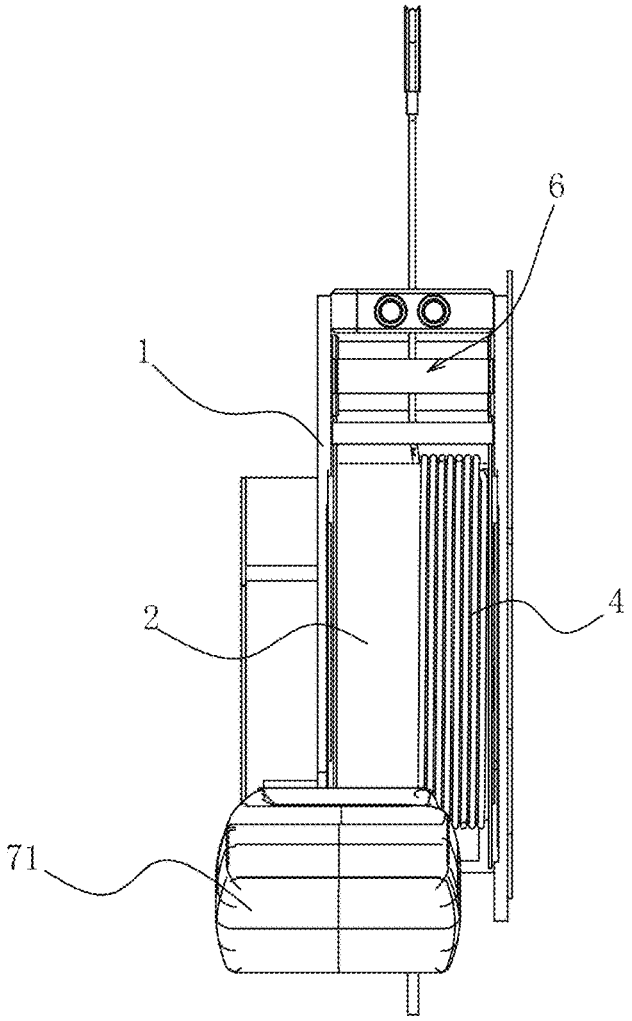
FIG. 2 is a right view of FIG. 1.
Figure 3:
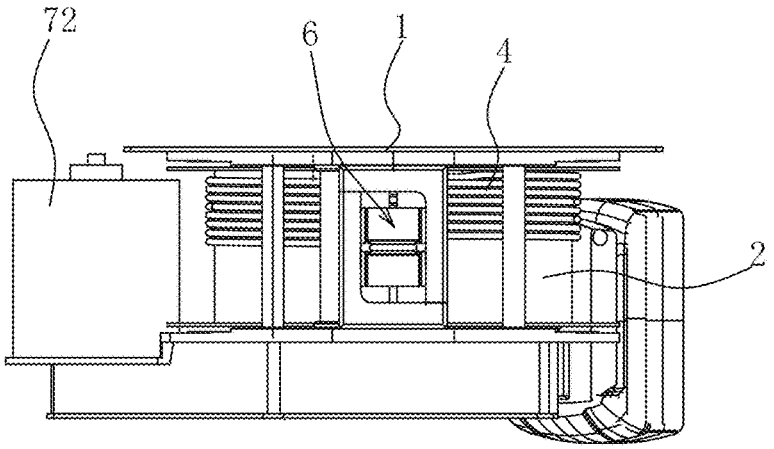
FIG. 3 is a left view of FIG. 1.
Figure 4:
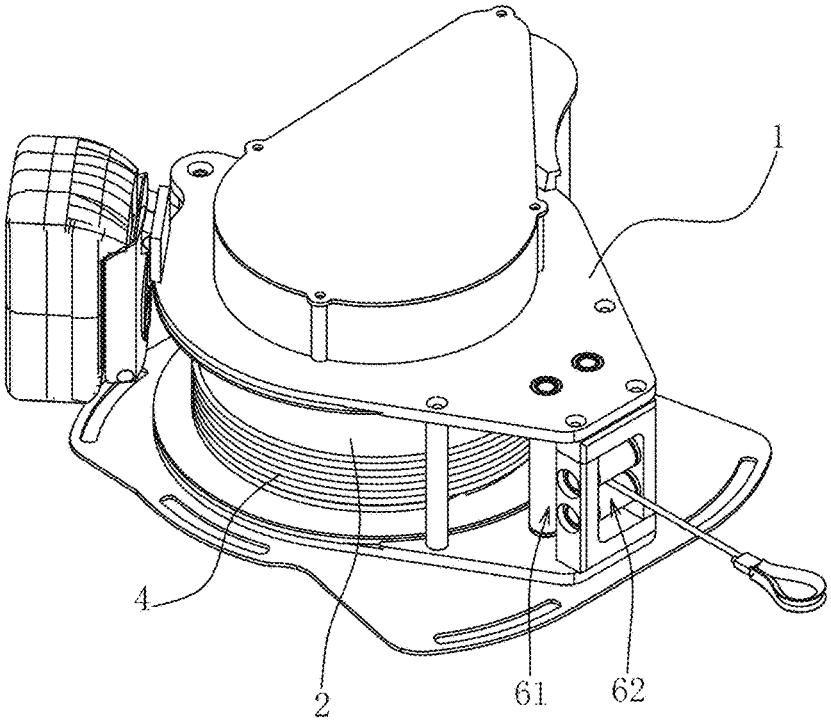
FIG. 4 is a stereoscopic view of FIG. 1.

To elucidate the solutions in the present disclosure, the present disclosure will be described in detail through preferred embodiments with reference to the accompanying drawings. The description below is essentially only for illustration, not for limiting the applications or purposes of the present disclosure. It should be understood that in the drawings, corresponding reference numerals represent same or identical parts and features.

As shown in FIGS. 1~8, the present disclosure provides a smart emergency escape backpack, comprising: a harness bound to a user, and a controlled descent mechanism; wherein the controlled descent mechanism includes an anchor support 1, a hub 2 mounted on the anchor support 1, and a centrifugal speed reduction damper 3 fitted with the hub 2, cable 4 being wound around the hub 2; and wherein a cable take-up actuating mechanism 7 is further provided on the anchor support 1, and the cable take-up actuating mechanism 7 includes an electric motor 72, a transmission structure 73 connected with the electric motor 72, and a synchronous wheel 74 connected with the transmission mechanism 73, the synchronous wheel 74 actuating the hub 2 to rotate reversely. In the present disclosure, the harness is coupled to the backpack. The harness-backpack structure is similar to a two-strap knapsack. The controlled descent mechanism is anchored in the backpack, wherein the cable therein is pulled out from the backpack. Of course, the harness may be separately provided so as to directly couple the harness to the controlled descent mechanism. The controlled descent mechanism in the present disclosure may be separately used from the harness, wherein the control descent mechanism is anchored to a pre-buried element, the harness being connected with the free end of the cable 4. The anchor support 1 is configured for secured fixation use, which may be connected with the harness. The hub 2 has a cylindrical structure for winding the cable 4. The cable take-up actuating mechanism 7 provided by the present disclosure may take up the cable 4, so as to recover the emergency escape backpack to the initial state, thereby facilitating repeated use. In the present disclosure, when the controlled descent mechanism is worn to a user and the free end of the cable 4 is hooked to the pre-buried element, the cable take-up actuating mechanism 7 will take up the controlled descent mechanism and the harness together. When the controlled descent mechanism is hooked to the pre-buried element and the free end of the cable 4 is hooked to the harness worn by the user, the cable take-up actuating mechanism 7 will take up the harness. The synchronous wheel 74 of the present disclosure may be coupled to the hub 2 directly or via other transmission mechanism. The synchronous wheel 74 mainly functions to drive the hub 2 to rotate reversely.

With reference to FIGS. 1~6 and 12, in the embodiments of the present disclosure, a cartridge battery 71 is further provided on the anchor support 1, the battery 71 being electrically connected with the electric motor 72. The cartridge battery is a rechargeable battery, which needs to be recharged periodically; meanwhile, a power shortage alarm device is further provided on the power supply 71 to alarm the user to charge. Additionally, the present disclosure further provides a charger 76 to facilitate charging. A battery plug socket 75 is provided at one side of the anchor support 1, the power supply 71 being plugged into the plug socket 75. Provision of the plug socket 75 in the present disclosure is to facilitate plugging of the power supply.

Figure 6:
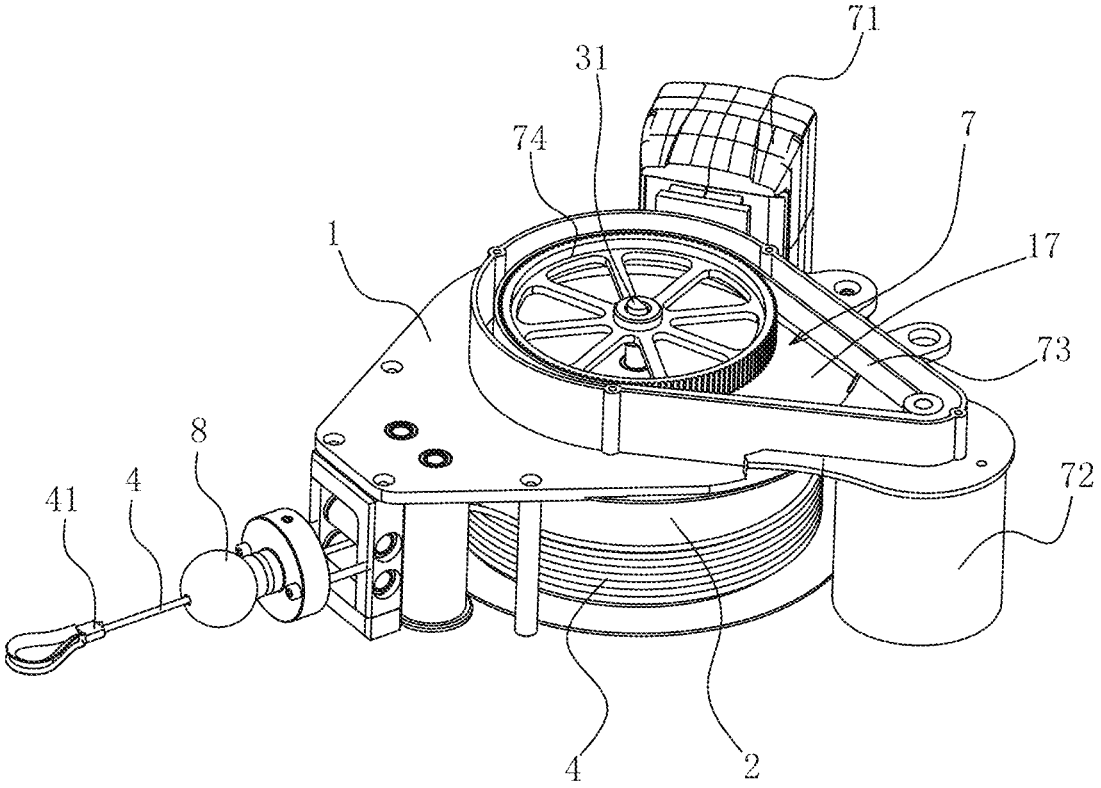
FIG. 6 is a stereoscopic view from another perspective of FIG. 5.

Referring to FIG. 6, in the embodiment provided above, the transmission mechanism 73 is a timing belt, and the synchronous wheel 74 is a timing pulley, the electric motor 72 being connected with the timing pulley via the timing belt. In the present disclosure, the electric motor and the timing pulley are connected via the timing belt, resulting in an easier transmission. The timing pulley has a larger diameter, playing a role of speed reduction. Of course, the transmission mechanism 73 of the present disclosure may adopt other structures, e.g., gear transmission. The synchronous wheel may also adopt a gear with a relatively large diameter.

Referring to FIG. 6, in the embodiments provided above, an accommodation cavity 17 is formed on the anchor support 1, the transmission mechanism 73 and the synchronous wheel 74 being mounted in the accommodation cavity 17. The accommodation cavity 17 functions to protect the transmission mechanism 73 and the synchronous wheel 74 to prevent catching foreign objects.

Figure 7:
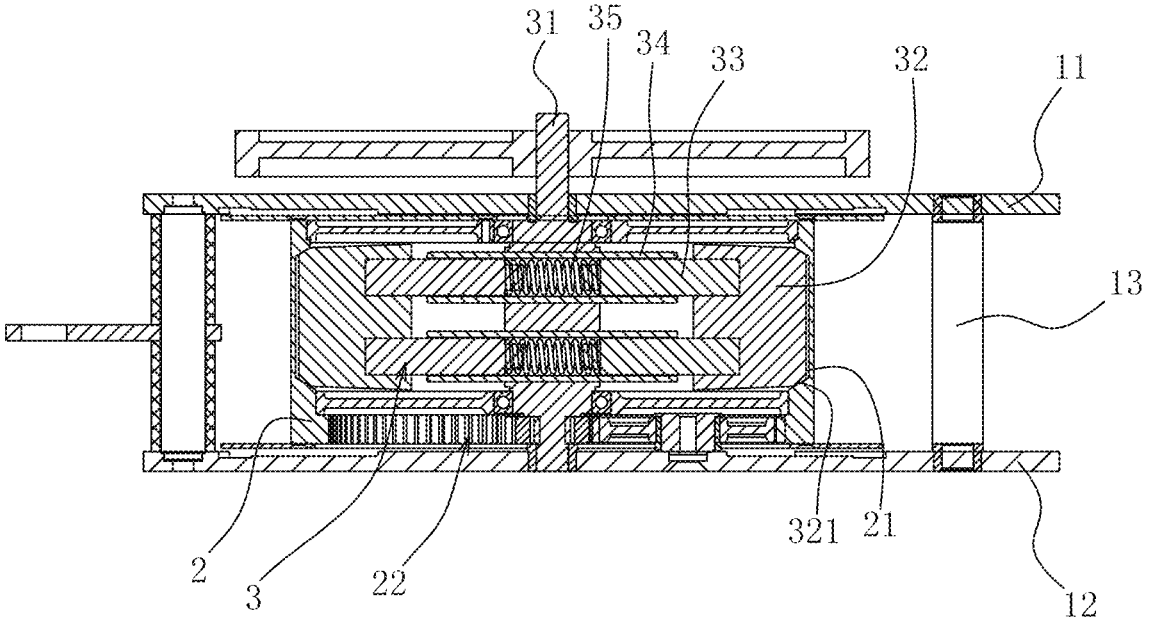
FIG. 7 is a sectional view of the controlled descent mechanism of the present disclosure.
Figure 8:
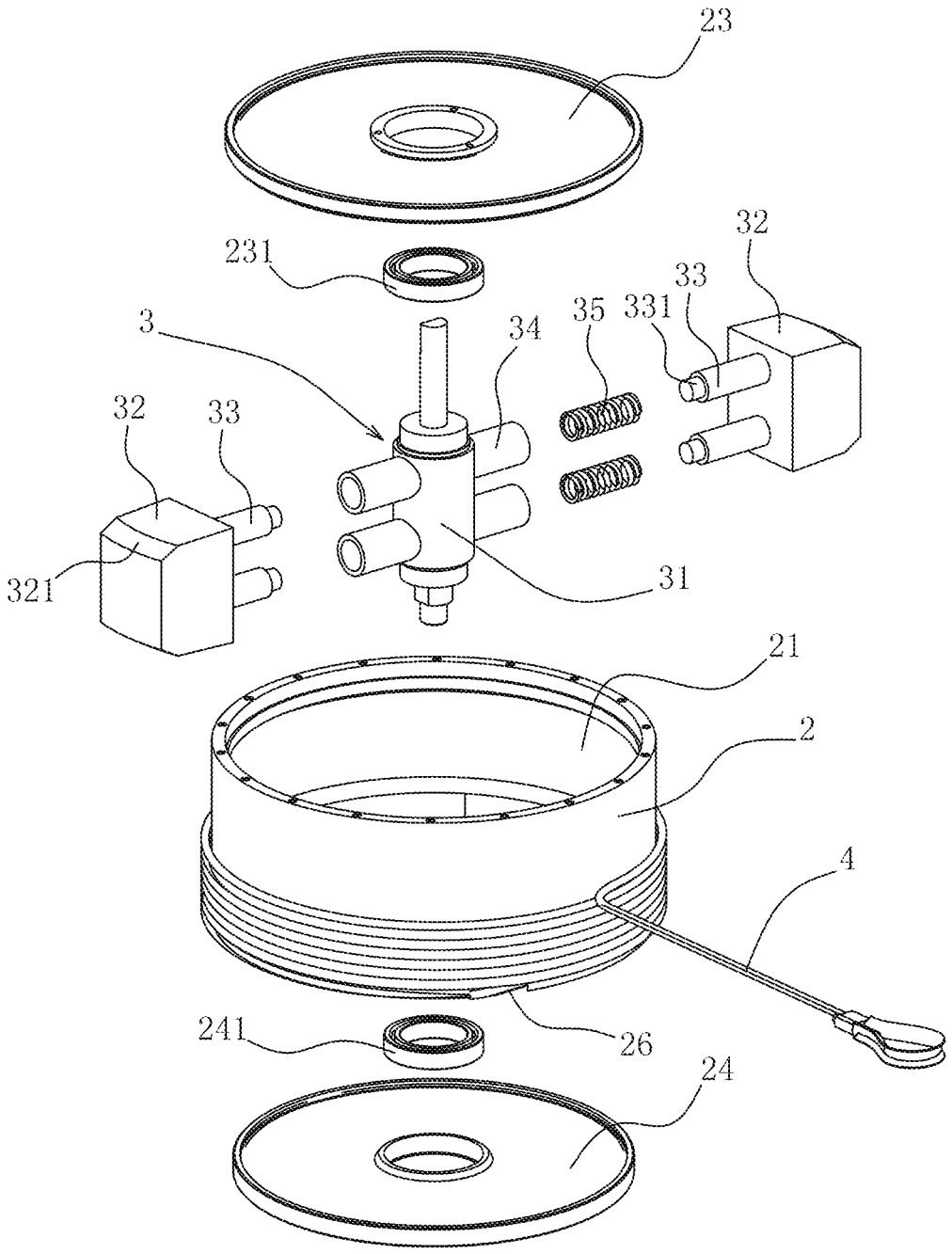
FIG. 8 is a stereoscopic exploded view of partial structure of the present disclosure.

Referring to FIGS. 7 and 8, in the embodiments provided above, the centrifugal speed reduction damper 3 comprises a spindle 31, centrifugal damping blocks 32 symmetrically disposed, guide rods 33 fixedly connected with the centrifugal damping blocks 32, and a hollow guiding conduit 34 connected vertically and securely with the spindle 31, the guide rods 33 being respectively inserted from two ends of the hollow guiding conduit 34, a spring 35 being disposed between the two guide rods 33, the spring 35 being disposed in the hollow guiding conduit 34, such that when the spindle 31 rotates, the centrifugal damping blocks 32 abut against the inner wall of the hub 2 under the action of a centrifugal force. The centrifugal damping blocks 32 in the present disclosure are connected with the spring 35 via the guide rods 33 and the conduit 34, the two centrifugal damping blocks 32 are communicative under stress, and the two centrifugal damping blocks 32 compensate with each other, thereby achieving a better balance and offering a better damping effect. With the fitting structure between the guide rods 33 and the conduit 34, the centrifugal damping blocks 32 will not be locked dead during a sliding process, offering a more reliable operation. In the present disclosure, rotating of the spindle 31 will drive the conduit 34 to rotate, thereby driving the centrifugal damping blocks 32 to rotate; under the action of the centrifugal force, the centrifugal damping blocks 32 will abut against the inner wall of the hub 2; the faster the spindle 31 rotates, the larger the centrifugal force subjected to the centrifugal damping blocks 32, and the larger the friction between the centrifugal damping blocks 32 and the hub 2, such that the centrifugal damping blocks 32 play a role of decelerating the hub 2, thereby maintaining the hub 2 to rotate uniformly.

Referring to FIGS. 7 and 8, in the embodiments disclosed above, a damping chamfer 321 is formed on each of the centrifugal damping blocks 32, a damping groove 21 is formed on the inner wall of the hub 2, and the damping chamfers 321 and the sidewall of the damping groove 21 are in fricative contact. In the present disclosure, the fitting structure between the damping blocks 32 and the damping groove 21 on the hub 2 offer a larger fricative area therebetween, thereby providing a better damping effect. By forming the damping chamfers 321 on the centrifugal damping blocks 32, the structure becomes easier to be machined and assembled. The sidewall of the damping groove 21 has a bevel structure, the damping chamfer 321 being fitted with the bevel.

Referring to FIG. 8, in the embodiments of the present disclosure, the damping chamfer 321 is configured arcuately along the length direction. The radian of the damping chamfer 321 is identical to the radian of the damping groove 21 of the hub 2, which guarantees a close contact therebetween and increases the contact area.

Referring to FIGS. 7 and 8, in the embodiments disclosed above, end portions of the guide rods 33 form a shoulder 331, the spring 35 being sleeved on the shoulder 331. The shoulder 331 is structured to facilitate fixing the spring 35.

Figure 5:
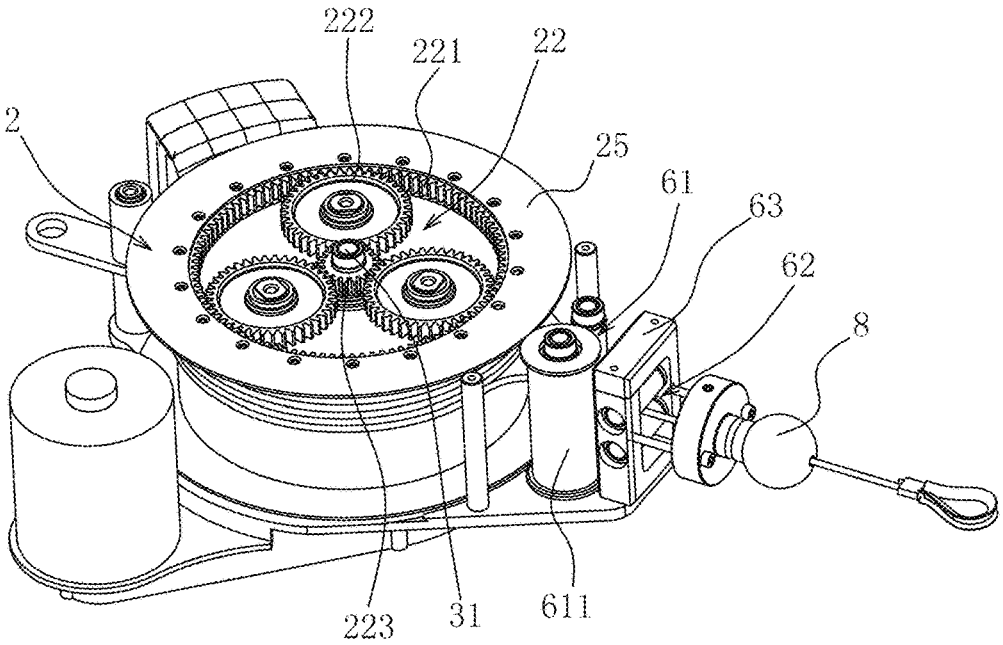
FIG. 5 is a stereoscopic view of a controlled descent mechanism with partial removal of an anchor support according to the present disclosure.

Referring to FIGS. 5, 7, and 8, in the embodiments disclosed above, the hub 2 actuates the spindle 31 to rotate via a planetary gear transmission mechanism 22; the spindle 31 drives the centrifugal damping blocks 32 to rotate, the rotating direction of the centrifugal damping blocks 32 is contrary to the rotating direction of the hub 2; and the synchronous wheel 74 is anchored to the spindle 31. With the planetary gear transmission mechanism 22, the hub 2 drives the centrifugal damping blocks 32 to rotate, causing the rotating direction of the centrifugal damping blocks 32 to be reverse to that of the hub 2; therefore, the centrifugal damping blocks 32 play a role of decelerating the hub 2. The faster the cable 4 is pulled, the faster the hub 2 rotates, and the larger the centrifugal force subjected to the centrifugal damping blocks 32, and the tighter the contact between the centrifugal damping blocks 32 and the hub 2, thereby reducing the rotational speed of the hub 2; after the rotational speed of the hub 2 decreases, the centrifugal force subjected to the centrifugal damping blocks 32 decreases, the fricative force between the centrifugal damping blocks 32 and the hub 2 decreases, while the rotational speed of the hub 2 increases; so on and so forth, a balance is achieved between the centrifugal force subjected to the centrifugal damping blocks 32 and the rotational speed of the hub 2. The rotational speed of the hub 2 is adjusted by setting the weight of the centrifugal damping blocks 32. In the present disclosure, the rotational speed is generally set to 0.5~1.5 meters per second, guaranteeing a safe descent of the user. In the present disclosure, the synchronous wheel 74 is connected with the hub 2 via a planetary gear transmission mechanism 22, the synchronous wheel 74 drives the spindle 31 to rotate, and the spindle 31 actuates the planetary gear transmission mechanism 22 to drive the hub 2 to rotate reversely.

Referring to FIG. 7, in the embodiment disclosed above, the anchor support 1 comprises a front support plate 11, a rear support plate 12, and a connection pillar 13 connecting the front support plate 11 and the rear support plate 12, the hub 2 being disposed between the front support plate 11 and the rear support plate 12. Providing of the front support plate 11 and the rear support plate 12 facilitates fixation and mounting; the hub 2 may rotate between the front support plate 11 and the rear support plate 12; the connection pillar 13 not only plays a role of connecting, but also plays a role of limiting the cable 4, thereby facilitating the hub 2 to wind the cable 4.

Referring to FIGS. 1 and 5, in the embodiments disclosed above, the connecting pillar 13 is provided in plurality, wherein one of the connecting pillars 131 is provided in the direction opposite to the cable lead-out direction, a hook 132 being provided on this connecting pillar 131. The connecting pillars not only play a role of connection, but also play a role of limiting the cable, thereby facilitating take-up and pay-off of the cable. The hook 132 is configured for being hooked to an external pre-buried element so as to suspend the controlled descent mechanism, and the user is coupled to the free end of the cable 4.

Referring to FIGS. 5 and 7, in the embodiments disclosed above, the planetary gear transmission mechanism 22 comprises a ring gear 221, a planetary gear 222 engaged with the ring gear 221, and a center gear 223 engaged with the planetary gear 222, wherein the ring gear 221 is disposed on the inner wall of the hub 2, the planetary gear 222 is mounted on the rear support plate 12, and the center gear 223 is securely connected with the spindle 31. Providing of the planetary gear transmission mechanism 22 may raise the transmission ratio, increase the rotational speed of the spindle 31, and enhance the damping effect.

Referring to FIGS. 5 and 8, in the embodiments disclosed above, the hub 2 is provided with an upper cover 23 and a lower cover 24, the upper cover 23, the lower cover 24, and the hub 2 forming a cavity, the centrifugal speed reduction damper 3 being mounted in the cavity, the upper cover 23 and the lower cover 24 being mounted onto the spindle 31 via bearings 231, 241. The hub 2 rotates about the spindle 3 and drives the spindle 31 to rotate via the planetary gear transmission mechanism 22.

Referring to FIG. 1, in the embodiments disclosed above, the cable 4 is made of a material selected from a group consisting of steel wire, nylon, plastics or carbon fiber, and the cable 4 being clad with a fire-proof layer or made by doping with a fire-proof material. In this embodiment, the cable is made of steel wire. The cable 4 has been subjected to fire-proof treatment, which can withstand a high temperature of above 1000° C., thereby enhancing safety.

Referring to FIGS. 2~5, in the embodiments disclosed above, a cable take-up and pay-off guiding mechanism 6 is provided on the anchor support 1, the guiding mechanism 6 including a first guide roller set 61 and a second guide roller set 62 which are arranged perpendicular to each other, the first guide roller set 61 and the second guide roller set 62 each including two guide rollers, wherein the diameter of the guide roller 611 around which the lead-out portion of the cable 4 is bent and wound in the first guide roller set 61 is greater than diameters of other guide rollers. In the present disclosure, the free end of the cable 4 passes through the two guide roller sets, such that the cable 4 is located by the mutually perpendicular guide roller sets. Particularly, the guide roller 611 where the lead-out portion of cable 4 is bent and wound at the lead-out position has a larger diameter, which increases the bend radius of the cable, reduces damages to the cable (particularly for steel cable), and also reduces the bend stress on the cable, thereby facilitating take-up and pay-off of the cable.

Referring to FIGS. 2 to 7, in the embodiments disclosed above, end portions of the first guide roller set 61 are respectively mounted on the front support plate 11 and the rear support plate 12, the end portions of the second guide roller set 62 are mounted on a frame 63, the frame 63 being mounted between the front support plate 11 and the rear support plate 12. Guide rollers of the second guide roller set 62 are respectively mounted on the front support plate 11 and the rear support plate 12 via the frame 63, such that the first guide roller set 61 and the second guide roller set 62 are perpendicular to each other. The above arrangement makes the mounting easier and the structure more reliable.

Referring to FIG. 5 and FIG. 8, in the embodiments disclosed above, a side plate 25 is mounted at each of the two sides of the hub 2, wherein the side plate 25 and the outer wall of the hub 2 form a wiring duct, the cable 4 being wound in the wiring duct. The wiring duct facilitates take-up, pay-off, and winding of the cable 4. A fixing slot 26 for fixing the end portions of the cable 4 is further provided on the hub 2, so as to facilitate secure fixation of the cable 4.

Referring to FIGS. 5 and 6, in the embodiments disclosed above, a travel switch 8 electrically connected with the cable take-up actuating mechanism 7 is further provided on the anchor support 1, and the free end of the cable 4 is provided with an expanded portion 41, the expanded portion 41 snap-acting on the travel switch 8. The travel switch 8 in the present disclosure may assume a plurality of forms, which may be a commercially available product, as long as it can trigger the travel switch on during the take-up process of the cable 4. With the travel switch 8, after the cable 4 is completely taken up, the expanded portion 41 at the free end triggers the travel switch 8 to stop the cable take-up actuating mechanism, thereby playing a role of protection.

Figure 9:
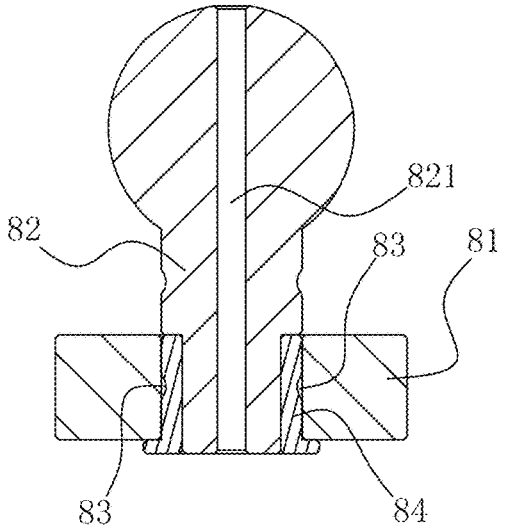
FIG. 9 is a sectional view of a travel switch of the present disclosure.
Figure 11:
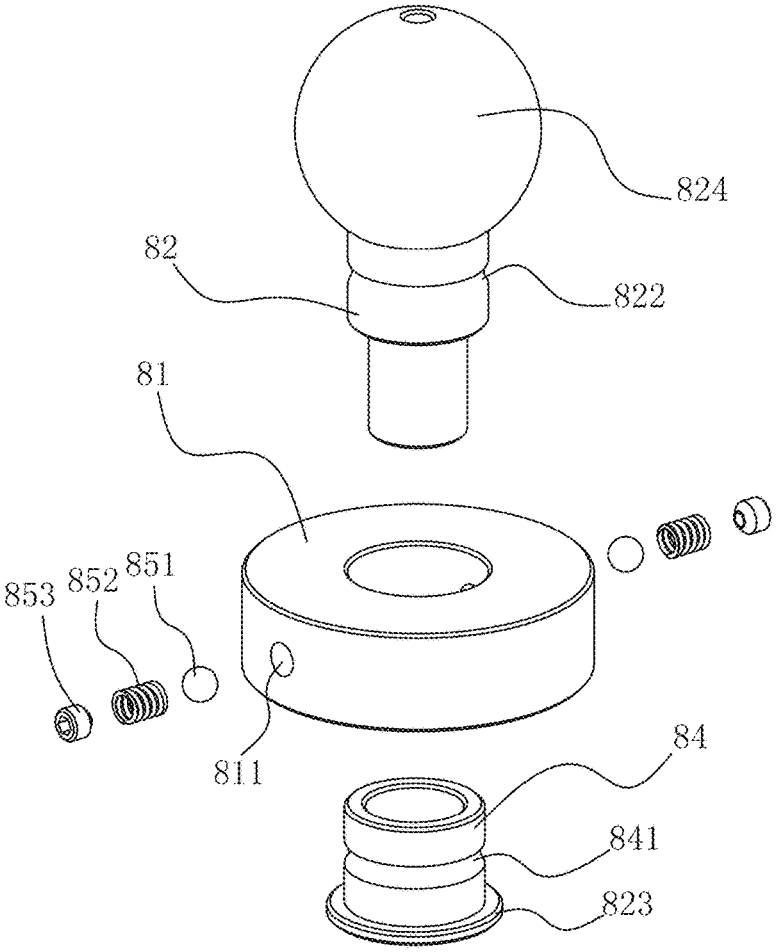
FIG. 11 is a stereoscopic exploded view of the travel switch according to the present disclosure.
Figure 12:
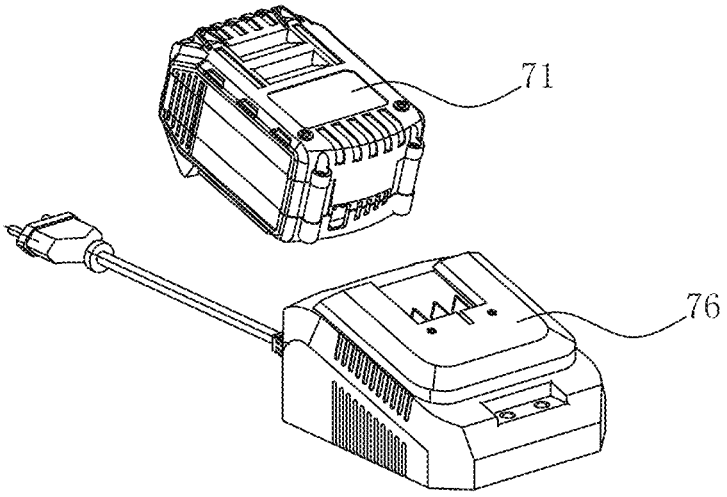
FIG. 12 shows a structural view of a power supply and a battery charger in the present disclosure.

Referring to FIGS. 6, 9, and 11, in the embodiments disclosed above, the travel switch 8 comprises a hollow base 81, and a pull rod 82 inserted into the base 81, an electrical contact 83 being provided on the base 81, the electrical contact 83 being bulged into the hollow cavity of the base 81, an electrically conducting ring 84 being provided on the portion of the pull rod 82 which is inserted into the hollow cavity of the base 81, the electrically conducting ring 84 being in contact with the electrical contact 83, the pull rod 82 being provided with a through-hole 821, the cable 4 passing through the through-hole 821, the expanded portion 41 pushing the pull rod 82 to reset. When the travel switch 8 of the present disclosure is working, the user pulls the pull rod 82, the pull rod 82 driving the electrically conducting ring 84 to move up to conduct the electric contact 83 projecting into the hollow cavity. In this embodiment, two electrical contacts 83 are provided, which are connected with a power supply circuit so as to control on/off of power supply to the cable take-up actuating mechanism 7. The cable 4 is taken up under the actuation by the cable take-up actuating mechanism 7; after the take-up is completed, the expanded portion 41 of the cable 4 will pull the pull rod 82 to reset, driving the electrically conducting ring 84 to move down to break the electrical contacts 83, and then the cable take-up actuating mechanism 7 stops working. The present disclosure enables automatic switch-on/off of the cable take-up actuating mechanism 7, which facilitates use. The expanded portion 41 refers to the portion provided at the free end of the cable 4 which is thicker than the remaining portion of the cable 4. The diameter of that portion of the cable may be increased by adding an accessory, or by folding the cable into two strands. Alternatively, that portion of the cable may be loosened to increase the diameter, as long as the free end of the cable cannot pass through the pull rod 82.

Figure 10:
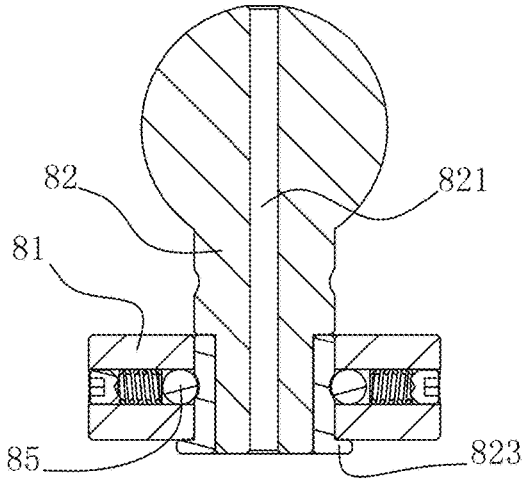
FIG. 10 is a sectional view of the travel switch from another perspective according to the present disclosure.

Referring to FIGS. 9 to 11, in the embodiments of the present disclosure, a locating mechanism 85 is provided on the base 81; the locating mechanism 85 includes a bead 851 projecting into the hollow cavity, a spring 852 pushing the bead 851, and a thread 853 abutting against the spring 852, wherein locating groove 822, 841 are respectively provided on the pull rod 82 and the electrically conducting ring 84, the bead 851 being snapped into the locating groove 822, 841. A channel 811 in communication with the hollow cavity is provided on the base 81, and the locating mechanism 85 is mounted in the passage 811. The locating mechanism 85 plays a role of locating, such that the travel switch can be located at a switch-on or switch-off position.

Referring to FIGS. 9 to 11, in the embodiments disclosed above, a limit flange 823 is provided on the pull rod 82, the flange 823 abutting against the base 81. The flange 823 plays a role of limiting the pull rod 82 from being pulled out. The flange 823 is shaped on the electrically conducting ring 84, and the electrically conducting ring 84 is mounted on the pull rod 82, thereby facilitating mounting.

Referring to FIG. 11, in the embodiments disclosed above, a ball-shaped grip portion 824 is provided at the top of the pull rod 82. The ball-shaped grip portion 824 facilitates manipulation.

In the embodiments disclosed above, a unidirectional clutch structure is provided between the synchronous wheel 74 and the spindle 31. By providing the unidirectional clutch, the present disclosure realizes that the synchronous wheel 74 does not rotate when the cable 4 is drawn out, which only rotates upon take-up. Such a unidirectional clutch may be a ratchet wheel or other structure.

In view of the above, what have been disclosed above are only preferred embodiments for illustrating the principle of the present disclosure, which are not intended for limiting the protection scope of the present disclosure. Any modifications, equivalent substitutions, and improvements within the spirit and principle of the present disclosure should be included within the protection scope of the present disclosure.

What is claimed is:

1. A backpack for emergency escape, comprising:

a harness bound to a user, and a controlled descent mechanism;

wherein the controlled descent mechanism comprises:

an anchor support, a hub mounted on the anchor support, and a centrifugal speed reduction damper fitted with the hub, and a cable being wound around the hub, wherein the centrifugal speed reduction damper comprises:

a rotating spindle, centrifugal damping blocks symmetrically disposed within the centrifugal speed reduction damper, guide rods fixedly connected with the centrifugal damping blocks, and a hollow guiding conduit connected vertically and securely to the rotating spindle;

wherein the guide rods are respectively inserted from two ends of the hollow guiding conduit with a spring being disposed between the guide rods and the spring being is disposed in the hollowing guiding conduit so that when the rotating spindle rotates, the centrifugal damping blocks abut against an inner wall of the hub upon an action of a centrifugal force; and wherein a cable take-up actuating mechanism is further provided on the anchor support, and the cable take-up actuating mechanism comprises:

an electric motor, a transmission mechanism connected with the electric motor, and a synchronous wheel connected with the transmission mechanism, the synchronous wheel actuating the hub to rotate reversely.

2. The backpack according to claim 1, wherein a battery is further provided on the anchor support, the battery being electrically connected with the electric motor, one side of the anchor support being provided with a battery plug socket, the battery being plugged in the battery plug socket.

3. The backpack according to claim 1, wherein the transmission mechanism is a timing belt, and the synchronous wheel is a timing pulley, the electric motor being connected with the timing pulley via the timing belt.

4. The backpack according to claim 1, wherein an accommodation cavity is formed on the anchor support, the transmission mechanism and the synchronous wheel being mounted in the accommodation cavity.

5. The backpack according to claim 1, wherein a damping chamfer is formed on each of the centrifugal damping blocks, a damping groove is formed on the inner wall of the hub, and the damping chamfers and a sidewall of the damping groove are in fricative contact.

6. The backpack according to claim 1, wherein the hub actuates the rotating spindle to rotate via a planetary gear transmission mechanism, the rotating spindle driving the centrifugal damping blocks to rotate, the rotating direction of the centrifugal damping blocks being contrary to the rotating direction of the hub, the synchronous wheel being fixed on the rotating spindle.

7. The backpack according to claim 1, wherein the anchor support is configured with a cable take-up and pay-off guiding mechanism, the guiding mechanism including a first guide roller set and a second guide roller set which are arranged perpendicular to each other, the first guide roller set and the second guide roller set respectively including two guide rollers, wherein a diameter of a guide roller of the first guide roller set, around which the cable is bent and wound, is greater than diameters of guide rollers of the first guide roller set and the second guide roller set.

8. The backpack according to claim 1, wherein a travel switch electrically connected with the cable take-up actuating mechanism is further provided on the anchor support, a free end of the cable being provided with an expanded portion, the expanded portion snap-acting on the travel switch.

9. The backpack according to claim 8, wherein the travel switch comprises a hollow base and a pull rod inserted into the base, an electrical contact being provided on the base, the electrical contact being bulged into a hollow cavity of the base, an electrically conducting ring being provided on the portion of the pull rod which is inserted into the hollow cavity of the base, the electrically conducting ring being in contact with the electrical contact, the pull rod being provided with a through-hole, the cable passing through the through-hole, the expanded portion pushing the pull rod to reset.

10. The backpack according to claim 9, wherein a locating mechanism is provided on the base; the locating mechanism includes a bead projecting into the hollow cavity, a spring pushing the bead, and a thread abutting against the spring; and a locating groove is provided on each of the pull rod and the electrically conducting ring, respectively, the bead being snapped into the locating grooves.

* * * * *